US006538571B1

(12) United States Patent
Huang

(10) Patent No.: US 6,538,571 B1
(45) Date of Patent: Mar. 25, 2003

(54) SWITCH ARRANGEMENT OF A WIRELESS BURGLAR ALARM SYSTEM

(76) Inventor: Dennis Huang, 5F, No, Lane 9, Ningpo E. St., Taipei (TW)

( * ) Notice: Subject to any disclaimer, the term of this patent is extended or adjusted under 35 U.S.C. 154(b) by 0 days.

(21) Appl. No.: 09/243,435

(22) Filed: Feb. 3, 1999

(51) Int. Cl.[7] ..... G08B 13/14

(52) U.S. Cl. ..... 340/568.1; 340/693.9; 340/687; 340/686.6; 340/539; 340/571; 224/269

(58) Field of Search ..... 340/568.1, 568.6, 340/687, 571, 539, 693.9, 693.12; 224/255, 269, 908, 163, 904; 24/3.11, 3.12, 3.1, 168, 170, 171, 334, 336, 307

(56) References Cited

U.S. PATENT DOCUMENTS 4,365,858 A * 12/1982 Karol ..... 439/135
4,589,713 A * 5/1986 Pfuhl et al. ..... 439/162
5,345,221 A * 9/1994 Pons et al. ..... 340/571
5,535,746 A * 7/1996 Hoover et al. ..... 600/432
5,617,074 A * 4/1997 White ..... 340/573.4
5,635,907 A * 6/1997 Bernard et al. ..... 340/573.4
5,680,105 A * 10/1997 Hedrick ..... 340/571
5,686,891 A * 11/1997 Sacca et al. ..... 340/571
5,757,271 A * 5/1998 Andrews ..... 340/568.1
5,877,686 A * 3/1999 Ibey et al. ..... 340/571
5,910,768 A * 6/1999 Ott ..... 340/568.2
5,979,019 A * 11/1999 Johnson ..... 24/3.11
6,040,772 A * 3/2000 Jackson et al. ..... 340/568.6

* cited by examiner

*Primary Examiner*—Benjamin C. Lee
(74) *Attorney, Agent, or Firm*—Bacon & Thomas

(57) ABSTRACT

A switch arrangement includes a transmitter, a receiver, and a locating mechanism, the transmitter and the receiver having a respective power circuit and a respective power on/off switch controlling the respective power circuit, the transmitter being controlled to transmit a radio signal, the receiver receiving the radio signal from the transmitter and running subject to the radio signal received, the locating mechanism being used to hold the transmitter and the receiver together, the power on/off switches of the receiver and the transmitter being forced to switch off the respective power circuits when the transmitter and the receiver are fastened together, the power on/off switches of the receiver and the transmitter automatically switching on the respective power circuits when the transmitter and the receiver are separated from each other.

11 Claims, 4 Drawing Sheets

SWITCH ARRANGEMENT OF A WIRELESS BURGLAR ALARM SYSTEM

BACKGROUND OF THE INVENTION

The present invention relates to a wireless burglar alarm system, and more particularly to such a wireless burglar alarm system which automatically turns on/off power supply.

A regular wireless burglar alarm system is generally comprised of a transmitter and a receiver. The transmitter and the receiver comprise a respective power circuit, and a respective power on/off switch controlling the respective power circuit. When in use, the power circuits of the transmitter and the receiver must be respectively switched on. When not in use, the power circuits of the transmitter and the receiver must be respectively switched off. If the user forgets to turn on the power circuit of the transmitter or the receiver, the burglar system becomes unable to function well. If the user forgets to turn off the power circuits of the transmitter and the receiver when not in use, battery power supply is wasted.

SUMMARY OF THE INVENTION

It is one object of the present invention to provide a wireless burglar alarm system which automatically turns off power supply when not in use. It is another object of the present invention to provide a wireless burglar alarm system which is compact and portable, and can be used as a handy illuminator. The present invention comprises a transmitter, a receiver, and a locating mechanism. The transmitter and the receiver comprise a respective power circuit and a respective power on/off switch controlling the respective power circuit. The transmitter is controlled to transmit a radio signal. The receiver receives the radio signal from the transmitter, and runs subject to the radio signal received. The locating mechanism is used to hold the transmitter and the receiver together. The power on/off switches of the receiver and the transmitter are forced to switch off the respective power circuits when the transmitter and the receiver are fastened together. On the contrary, the power on/off switches of the receiver and the transmitter automatically switch on the respective power circuits when the transmitter and the receiver are separated from each other. The transmitter can be put in the object to be protected, and the receiver can be carried by the user. When the distance between the transmitter and the receiver surpasses a predetermined range, the receiver immediately outputs an alarm signal. The locating mechanism can be provided at the receiver, or the transmitter. Hook and loop materials, adhesive tape, box, elastic band, etc., may be used instead of the locating mechanism to fasten or hold the transmitter and the receiver together. A coupling mechanism may be provided to fasten a clip to the receiver. A lighting circuit may be installed in the receiver.

DETAILED DESCRIPTION OF THE PREFERRED EMBODIMENT

Figure 1:
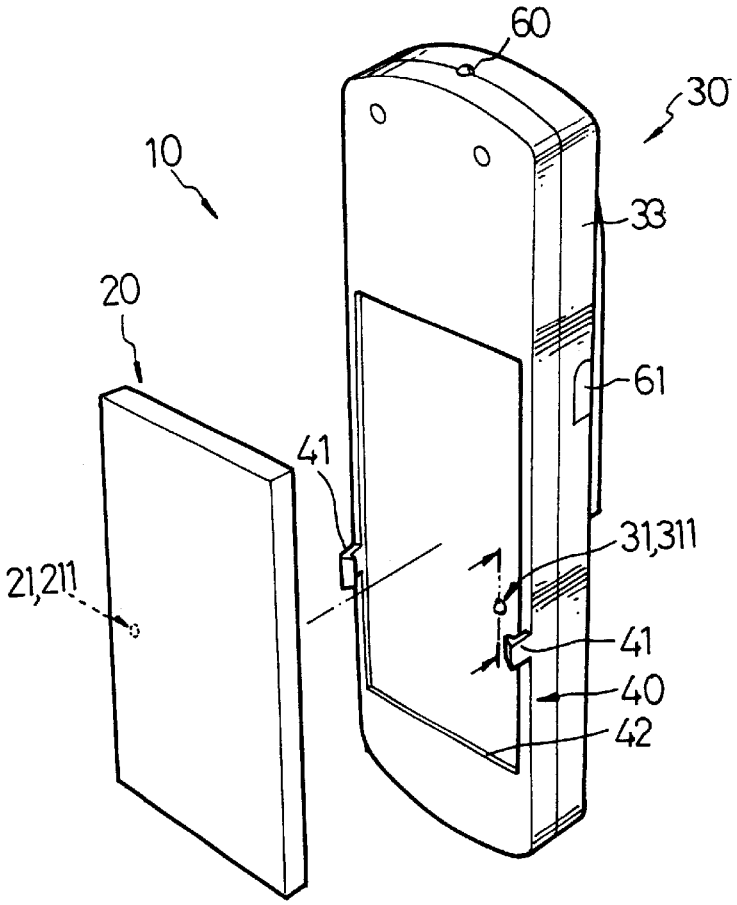
FIG. 1 is an exploded view of a transmitter and a receiver according to the present invention.

Referring to FIGS. from 1 through 4, a wireless burglar alarm system 10 is shown comprised of a transmitter 20, a receiver 30, and a locating mechanism 40.

The receiver 30 receives radio signal from the transmitter 20, and runs subject to the instruction of the radio signal received. When in use, the transmitter 20 is put with the object to be protected together, and the receiver 30 is carried by the user. When the receiver 30 is carried by the user away from the transmitter 20 over a set distance, the receiver 30 receives no signal from the transmitter 20. A certain length of time after having received no signal from the transmitter 20, the receiver 30 immediately shrieks or vibrates to remind the user. This radio transmission operation is of the known art and not within the scope of the present invention, it is not described in detail.

Figure 3:
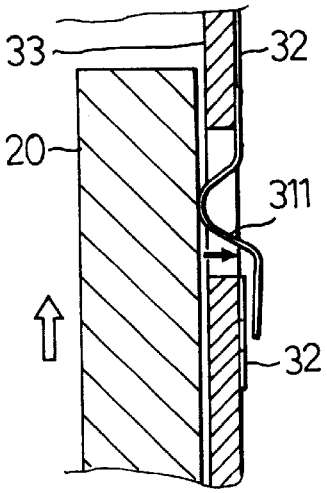
FIG. 3 is similar to FIG. 2 but showing the transmitter set into position, the power on/off switch of the receiver switched off.
Figure 2:
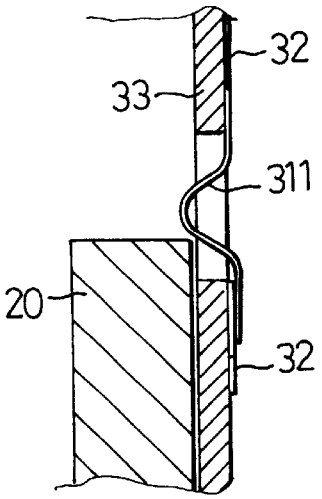
FIG. 2 is a sectional view showing the transmitter attached to the receiver according to the present invention.
Figure 4:
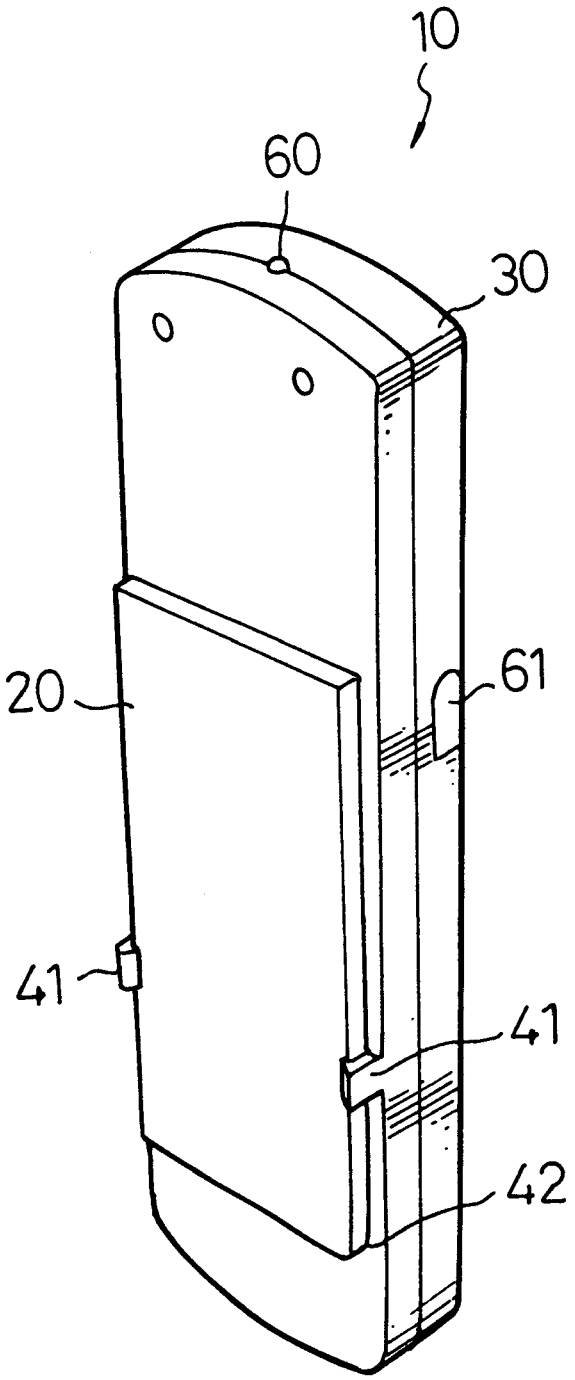
FIG. 4 is a perspective view showing the transmitter and the receiver fastened together.

The transmitter 20 and the receiver 30 comprise a respective power on/off switch 21 or 31. The power on/off switch 21 or 31 is comprised of a projecting spring leaf 211 or 311. The projecting spring leaf 311 of the receiver 30, as shown in FIGS. 2 and 3, has a curved middle part projecting out of the shell 33 of the receiver 30, a fixed end securely connected to a first contact at a power circuit 32, and a free end disposed in contact with a second contact of the power circuit 32. The power on/off switch 21 of the transmitter 20 has the arrangement.

The locating mechanism 40 comprises two retainers (for example, springy hooks) 41 and a holder means 42. The retainers 41 are bilaterally disposed on the shell 33 of the receiver 30, and made subject to the profile of the transmitter 20. The holder means 42 is a recessed seat disposed on the shell 33 between the retainers 41 for receiving the transmitter 20. The transmitter 20 fits the recessed seat of the holder means 42. When the transmitter 20 is put in the recessed seat of the holder means 42, it is retained in place by the retainers 41. As an alternate form of the present invention, the locating mechanism 40 can be made having three retainers 41 disposed at three sides of the recessed seat of the holder means 42.

When the transmitter 20 and the receiver 30 are fastened together, the projecting spring leaf 211 of the transmitter 20 is forced inwards by the shell 33 of the receiver 30 and the projecting spring leaf 311 of the receiver 30 is forced inwards by the shell of the transmitter 20, thereby causing the power on/off switches 21 and 31 to cut off the respective power circuits 32.

Further, the receiver 30 is equipped with a lighting circuit, therefore it can be used as an illuminator. The lighting circuit of the receiver 30 comprises a lamp bulb 60 disposed on one end of the receiver 30, and a control switch 61 mounted in a hole 331 at one lateral side of the receiver 30.

Figure 5:
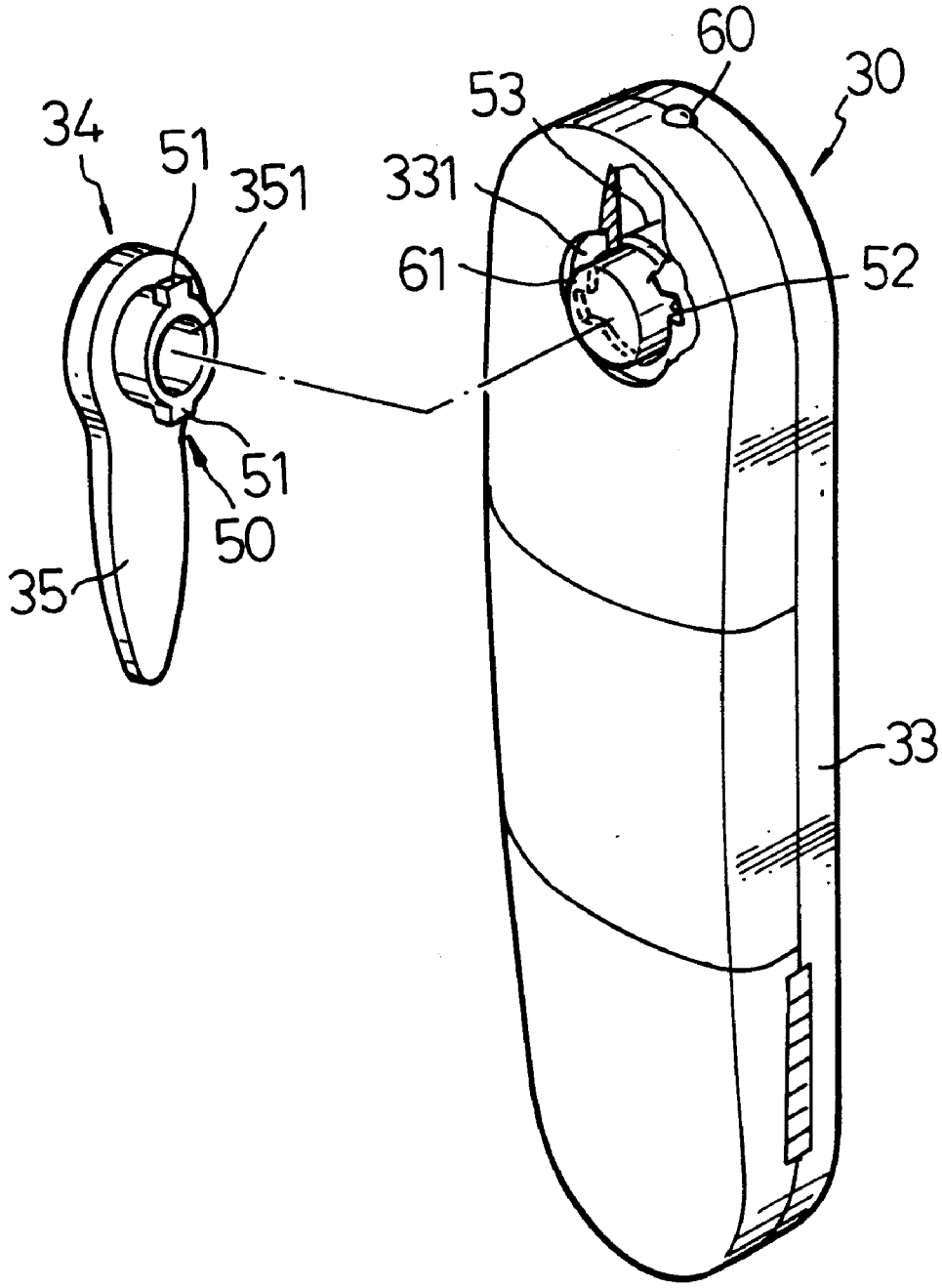
FIG. 5 is an exploded view of the clip and the receiver according to the present invention, showing the structure of the coupling mechanism.
Figure 6:
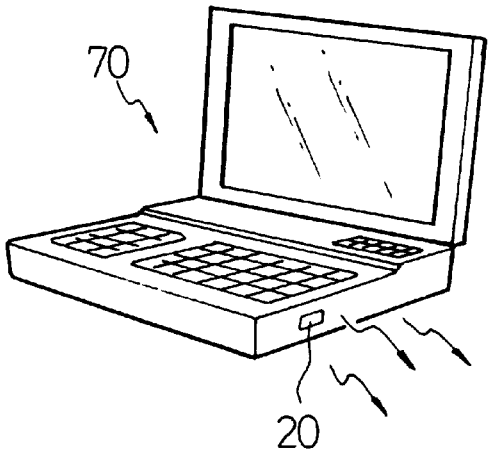
FIG. 6 shows an application example of the present invention.
Figure 6:
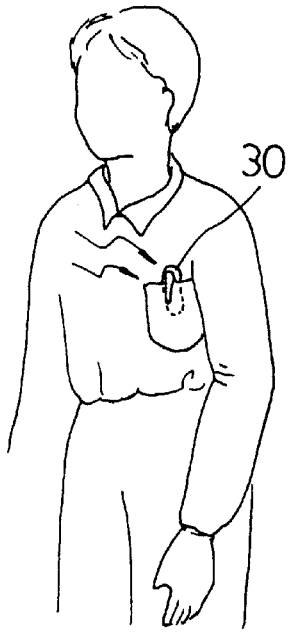

Referring to FIGS. 5 and 6, a clip 34 is fastened to the receiver 30 by a coupling structure 50. The clip 34 comprises a clip body 35, and a coupling hole 351 at one end of the clip body 35. The coupling structure 50 comprises a pair of lugs 51, a pair of guide slots 52, and a track 53. The lugs 51 are formed integral with the clip body 35 of the clip 34 at two opposite sides of the coupling hole 351. The track 53 is disposed behind the guide slots 52 inside the receiver 30.

The clip 34 is fastened to the receiver 30 by inserting the lugs 51 through the guide slots 52 into the track 53 and then turning the clip 34 through an angle to move the lugs 51 away from the guide slots 52, enabling the lugs 51 to be retained to the inside of the shell 33 of the receiver 30 in the track 53. By means of the clip 34, the receiver 30 can be fastened to the pocket (see FIG. 6).

Referring to FIG. 6 again, the transmitter 20 can be made in the form of a diskette, and inserted into a diskdrive (not shown) in a notebook computer 70. The receiver 30 is fastened to the user's pocket. When the distance between the receiver 30 and the notebook computer 70 surpasses a predetermined range, the receiver 30 receives no signal from the transmitter 20, and the alarm of the receiver 30 is triggered to output an audio alarm signal, reminding the user to take the necessary steps.

It is to be understood that the drawings are designed for purposes of illustration only, and are not intended as a definition of the limits and scope of the invention disclosed. The locating mechanism can be provided at the transmitter 20 for securing the receiver 30 to the transmitter 20. Hook and loop materials, adhesive tape, box, elastic band, etc., can be used to fasten or hold the transmitter 20 and the receiver 30 together instead of the aforesaid locating mechanism.

What the invention claimed is:

1. A switch an arrangement comprising:

a transmitter to transmit a radio signal;

a receiver to receive the radio signal from said transmitter and run subject to the radio signal received; and locating means for holding said transmitter and said receiver together, said transmitter and said receiver having a respective power circuit and a respective power on/off switch controlling the respective power circuit, wherein said power on/off switch is forced to switch off said power circuit when said transmitter and said receiver are fastened together by said locating means.

2. The switch arrangement of claim 1 wherein said locating means is provided at said receiver to secure said transmitter to said receiver.

3. The switch arrangement of claim 2 wherein said locating means comprises a plurality of retainers respectively raised from a shell of said receiver at one side for securing said transmitter.

4. The switch arrangement of claim 1 wherein said receiver comprises a lighting circuit, said lighting circuit comprises a lamp bulb, and a control switch operated to turn on/off said lamp bulb.

5. The switch arrangement of claim 4 wherein said control switch is mounted in a hole at a shell of said receiver.

6. The switch arrangement of claim 1 wherein said receiver comprises a shell, a coupling structure, and a clip fastened to said shell by said coupling structure, said coupling structure comprises a pair of guide slots formed in the shell of said receiver, a track formed in the shell of said receiver behind said guide slots, and a pair of lugs formed integral with said clip and inserted through said guide slots into said track and turned with said clip through an angle into engagement with said track.

7. The switch arrangement of claim 6 wherein said clip has a coupling hole coupled to a part in the shell of said receiver.

8. The switch arrangement of claim 1 wherein said locating means is provided at said receiver.

9.The switch arrangement of claim 8 wherein said locating means comprises a plurality of retainers disposed on said receiver subject to the profile of said transmitter for securing said transmitter to said receiver.

10. The switch arrangement of claim 1 wherein said receiver comprises a lighting circuit, and said lighting circuit comprises a lamp bulb and a control switch operated to turn of/off said lamp bulb.

11. The switch arrangement of claim 10 wherein said control switch is mounted in a hole at a shell of said receiver.

* * * * *